US012193563B1

(12) United States Patent
Williamson

(10) Patent No.: US 12,193,563 B1
(45) Date of Patent: Jan. 14, 2025

(54) CONTAINER CLIP

(71) Applicant: Richard Williamson, Las Vegas, NV (US)

(72) Inventor: Richard Williamson, Las Vegas, NV (US)

( * ) Notice: Subject to any disclaimer, the term of this patent is extended or adjusted under 35 U.S.C. 154(b) by 176 days.

(21) Appl. No.: 18/116,688

(22) Filed: Mar. 2, 2023

(51) Int. Cl.
*A45F 5/02* (2006.01)

(52) U.S. Cl.
CPC ..... *A45F 5/022* (2013.01); *A45F 2200/0583* (2013.01)

(58) Field of Classification Search
CPC ..... A45F 2200/0583; A45F 5/02
USPC ..... 224/148.1, 148.4, 148.7, 918; D3/202, D3/215; D7/620
See application file for complete search history.

(56) References Cited

U.S. PATENT DOCUMENTS 4,955,572 A * 9/1990 Simmons ..... A45F 5/02 224/679
6,019,335 A * 2/2000 Sehati ..... A45F 5/021 248/312
6,253,974 B1 * 7/2001 Park ..... A44B 11/005 224/183
6,279,794 B1 * 8/2001 Miyazaki ..... A45F 3/16 D3/229
6,422,955 B1 * 7/2002 Lopez ..... A42B 1/24 473/406
6,837,472 B1 * 1/2005 Beutz ..... A45F 3/16 248/689
7,614,532 B1 * 11/2009 Dague ..... A45F 5/02 224/667
8,240,525 B2 * 8/2012 Stojkovski ..... A45F 5/02 224/148.4
8,690,166 B2 * 4/2014 Peota ..... B62B 3/1472 220/482
10,578,246 B2 * 3/2020 Peteranecz ..... A63H 33/42
2002/0066758 A1 * 6/2002 Fadal, II ..... B65D 23/003 224/269
2004/0238578 A1 * 12/2004 Wagenknecht ..... A45F 5/10 224/269
2005/0127120 A1 * 6/2005 Pablo ..... A45F 5/00 224/605
2008/0083794 A1 * 4/2008 Wagenknecht ..... A45F 5/02 224/230
2010/0012807 A1 * 1/2010 Perman ..... A45F 5/02 248/312
2010/0206919 A1 * 8/2010 Boyom ..... A45F 5/02 224/148.1

* cited by examiner

*Primary Examiner* — Justin M Larson
(74) *Attorney, Agent, or Firm* — QuickPatents; Kevin Prince

(57) ABSTRACT

The present invention is a container clip for securing a container to a pocket, including a clip body having a first end and an opposing second end. In some embodiments, the first end of the clip body terminating with a resilient U-shaped clip having two prongs configured for securing around a portion of the container in a common plane, each prong terminating at a distal end thereof at an inwardly-facing projection. In some embodiments, the second end of the clip body terminating at a token holder configured for holding a token having one of a plurality of different visual appearances. In some embodiments, the clip body curved downwardly away from the common plane of the U-shaped clip such that the container clip curves down around a top portion of the container.

12 Claims, 3 Drawing Sheets

CONTAINER CLIP

CROSS-REFERENCE TO RELATED APPLICATIONS

Not Applicable.

STATEMENT REGARDING FEDERALLY SPONSORED RESEARCH AND DEVELOPMENT

Not Applicable.

FIELD OF THE INVENTION

This invention relates to container holders, and more particularly to a container clip for securing a container to a garment pocket, or the like.

BACKGROUND

During a party or other get together it is common for people to misplace their water bottle, soda bottle, beer bottle, or the like (herein collectively referred to as simply water bottle). It can also be a struggle to identify one's water bottle among several others that have been left on a table or counter, for example. To uniquely identify a water bottle, some people mark their water bottle or put a label on the water bottle with a unique marking, but markings can rub off particularly when exposed to spilled water, and suitable markers are not always available. Stickers can be applied to water bottles, but stickers also can easily become detached and they are certainly not reusable, and are also not always available.

One solution would be to maintain possession of one's water bottle throughout the gathering, but most beverage containers are too large for a person's pockets, and cold drinks can be uncomfortable against the person's skin. Condensation from the container can also make one's pants uncomfortably wet.

Prior solutions include lanyards that hang around a person's neck, but these are also uncomfortable and not visually attractive. Therefore, there is a need for a device that allows a container to be kept affixed with a person's garment pocket, but that keeps the container away from the garment. Such a needed invention would be easily color-coded and could include a visually unique token for quick identification. Further, such a needed device would be relatively inexpensive to manufacture and intuitive to use. The present invention accomplishes these objectives.

SUMMARY OF THE INVENTION

The present device is a container clip for securing a container to a pocket, or the like. The container may be any type of bottle, can, cup, or the like that has a neck portion suitable for grasping by the container clip. In a typical water bottle type container, for example, as illustrated, the container clip attaches to the container at a neck portion just below a container cap.

The container clip includes a clip body that has a first end and an opposing second end. The first end of the clip body terminates with a resilient U-shaped clip that has two prongs configured for securing around the neck portion of the container in a common plane. Each prong terminates at a distal end thereof at an inwardly-facing projection.

The second end of the clip body terminates at a token holder configured for holding a token having one of a plurality of different visual appearances. The token holder is preferably circular and includes a recess for receiving the token therein, either with a friction fit or attraction of a magnet embedded in the token holder. In some embodiments the token holder terminates at a keyring loop at a distal end thereof, facilitating retention of the container clip with a key ring, for example. The token may also be a resin plug or infill, an adhesive sticker or label, or the like.

The clip body curves downwardly away from the common plane of the U-shaped clip at an angle such that the container clip curves down around a top portion of the container. Preferably the angle is between 30-degrees and 60-degrees. The clip body is rigid enough to hold the container outwardly from, for example, jeans when the container clip is inserted into the pocket of the jeans. The clip body is not so rigid, however, that the prongs are difficult to separate when inserting the neck portion of the container therein. Having a set of the container clips, each with a unique color, facilitates identification of one's beverage should the container be set down on a counter or table, for example. Having a wide variety of the tokens also facilitates proper personal identification of one's container.

In use, with the U-shaped clip affixed with the container and with the second end of the clip body inserted into the pocket, the container clip and the container are supported by the pocket. The token may be interchanged with a different token in the token holder as desired, and can be included with the container clip or not.

The present invention is a device that allows a container to be kept affixed with a person's garment pocket, or the like, but that keeps the container away from the garment. The present device is easily color-coded and can include a visually unique token for quick visual identification. Further, the present invention is relatively inexpensive to manufacture and intuitive to use. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
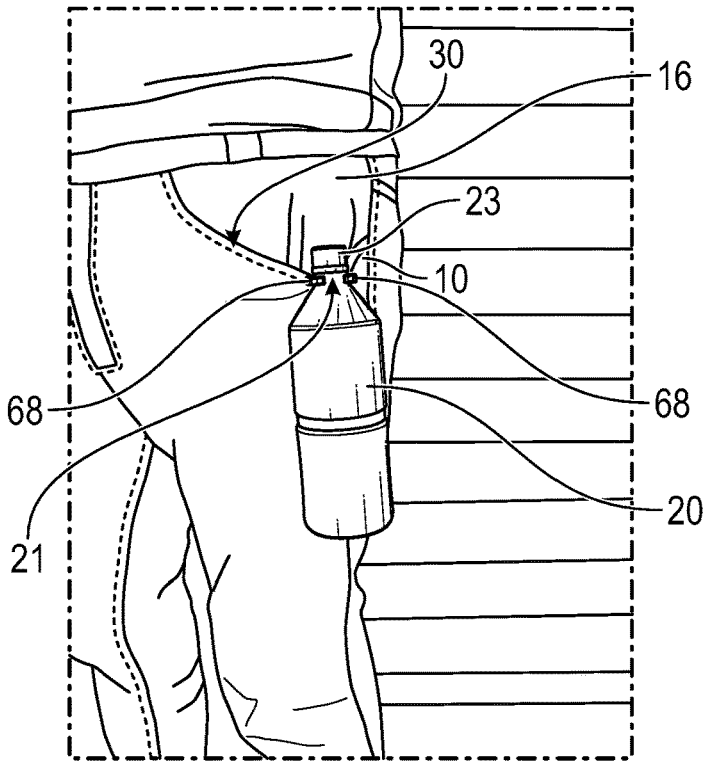
FIG. 1 is a perspective view of the invention, illustrated in-use while holding a container to a garment pocket.
Figure 2:
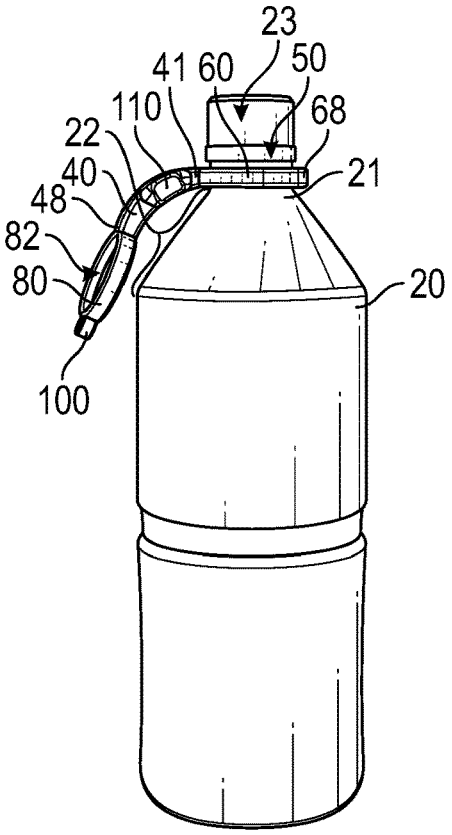
FIG. 2 is a side elevational view of the invention as attached with the container.
Figure 3:
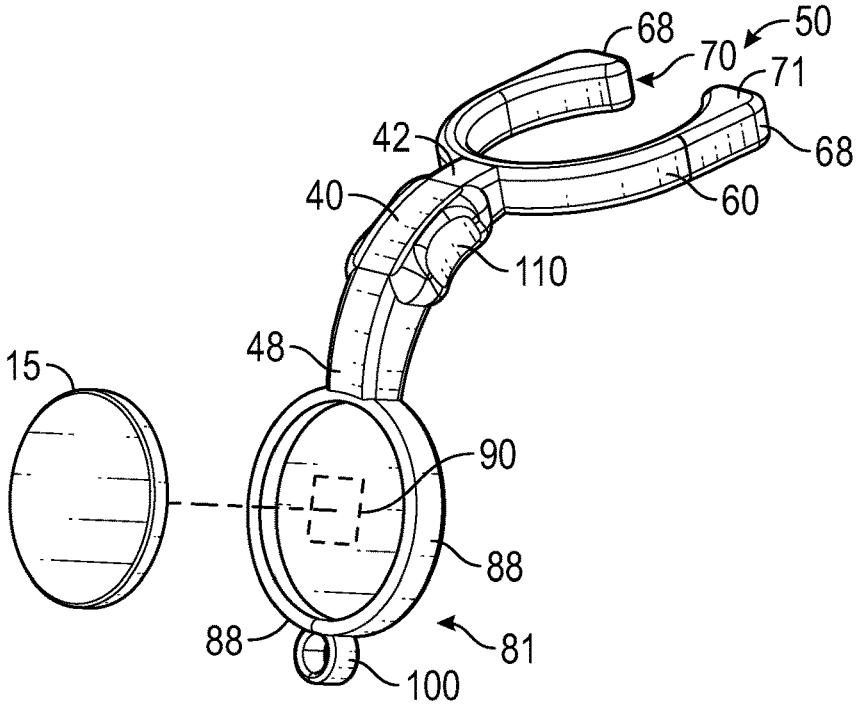
FIG. 3 is a perspective view of a preferred embodiment of the invention.

FIGS. 1-3 illustrate a container clip 10 for securing a container 20 to a pocket 30, or the like. The container 20 may be any type of bottle, can, cup, or the like that has a neck portion 21 suitable for grasping by the container clip 10. In a typical water bottle type container 20, for example, as illustrated, the container clip 10 attaches to the container 20 at a neck portion 21 just below a container cap 23.

The pocket 30 may be a pants pocket 30, a waist band (not shown), or other suitable receiver of the container clip 10 that can support the container clip 10 and the container 20. An automotive tray (not shown), or a backpack strap (not shown), or other suitable support may be utilized as the pocket 20, and thus the invention is not limited to pockets 20 per se, as users can find many suitable places in which to use the container clip 10 effectively. For the purposes of this disclosure, the pocket 20 is assumed to be a pocket 20 on a pair of pants 16, shorts, or other garment, for example.

Figure 4:
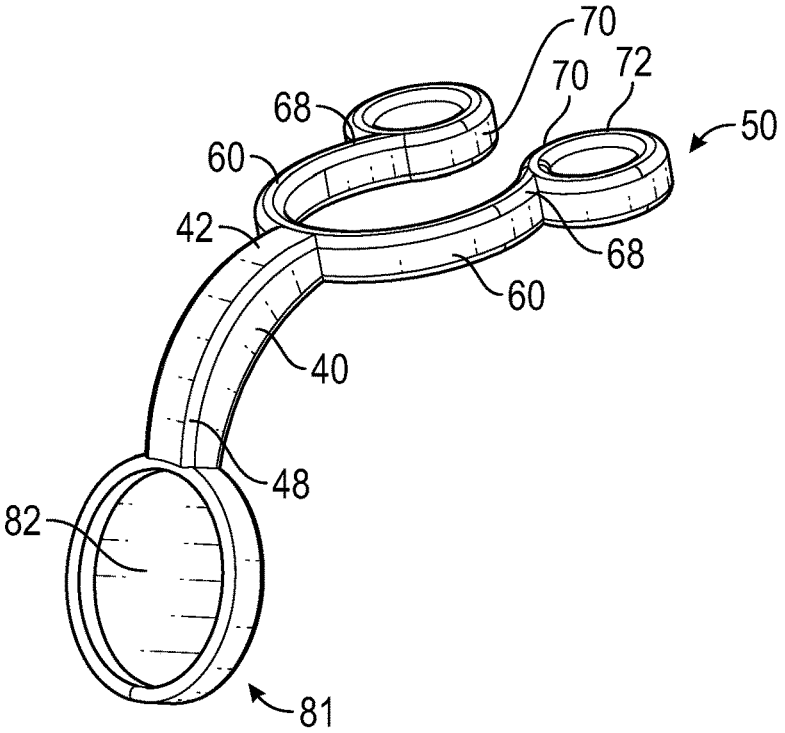
FIG. 4 is a perspective view of an alternate embodiment of the invention.
Figure 5:
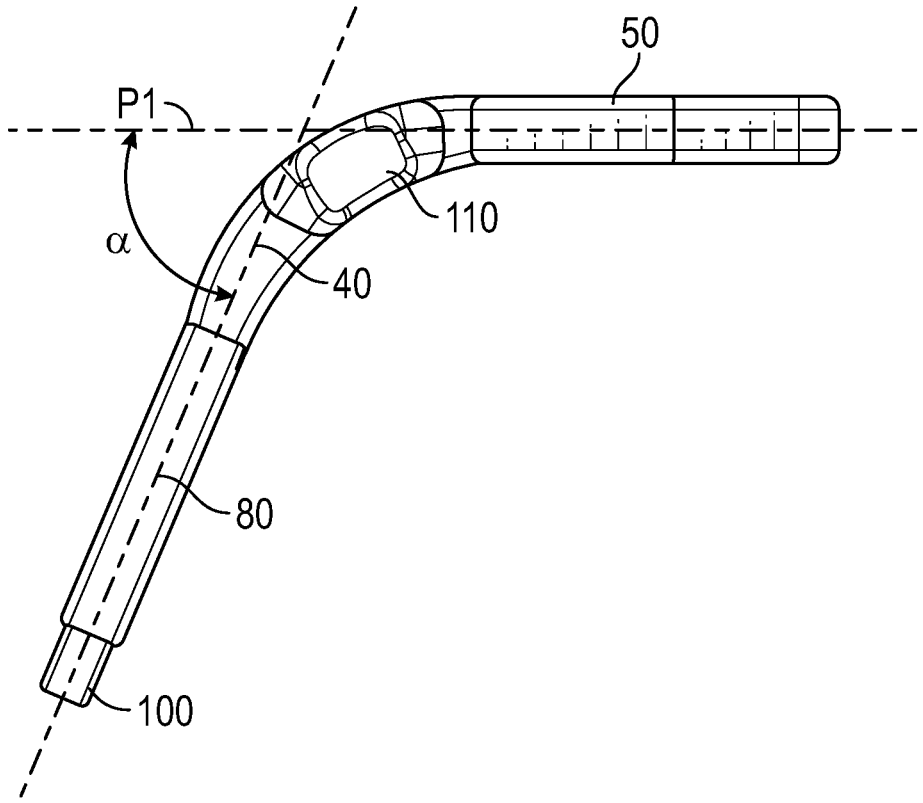
FIG. 5 is a side elevational view of the invention.

The container clip 10 includes a clip body 40 that has a first end 42 and an opposing second end 48. The first end 42 of the clip body 40 terminates with a resilient U-shaped clip 50 that has two prongs 60 configure for securing around the neck portion 21 of the container 20 in a common plane $P_1$ (FIG. 5). Each prong 60 terminates at a distal end 68 thereof at an inwardly-facing projection 70. The inwardly-facing projection may take the form of a triangle 71 (FIG. 3), a circle 72 (FIG. 4), or other suitable shape for gripping and securing the neck portion 21 of the container 20.

The second end 48 of the clip body 40 terminates at a token holder 80 configured for holding a token 15 (FIG. 3) having one of a plurality of different visual appearances. For example, the token 15 may be a coin (not shown) such as a quarter, a sobriety chip (not shown), a challenge coin (not shown), a POG, an epoxy resin slug, an adhesive sticker, or the like, such token 15 being one of many different unique tokens 15 that can be made available. The token holder 80 is preferably circular and includes a recess 82 for receiving the token 15 therein, either with a friction fit or attraction of a magnet 90 embedded in the token holder 80 (FIG. 3). Tokens 15 that are magnetically attractive are used for the magnet 90 to be effective, otherwise a friction fit is relied upon to keep the token 15 within the token holder 80. Other attachment means may be utilized as desired, such as hook-and-loop type fastener material (not shown), adhesives (not shown), a mechanical slot (not shown) that opens laterally at the token holder 80, or the like. The token holder 80 may alternately be a flat surface configured for receiving an adhesive label (not shown) or other marking or indicia.

In some embodiments the token holder 80 terminates at a keyring loop 100 at a distal end 88 thereof, facilitating retention of the container clip 10 with a key ring (not shown), for example.

The clip body 40 curves downwardly (FIG. 5) away from the common plane $P_1$ of the U-shaped clip 50 at an angle $\alpha$ such that the container clip 10 curves down around a top portion 22 (FIG. 2) of the container 20. Preferably the angle $\alpha$, is between 30-degrees and 60-degrees. The clip body 40 is rigid enough to hold the container 20 outwardly from, for example, jeans 16 when the container clip 10 is inserted into the pocket 30 of the jeans 16, as illustrated in FIG. 1. The clip body 40 is not so rigid, however, that the prongs 60 are difficult to separate when inserting the neck portion 21 of the container 20 therein. ABS or PVC plastic is a preferred material for the clip body 40, and both can be readily injection molded in many different colors. Other suitable plastic materials may be used as well. Having a set of the container clips 10, each with a unique color, facilitates identification of one's beverage should the container 20 be set down on a counter or table, for example. Having a wide variety of the tokens 15 also facilitates proper personal identification of one's container 20.

In use, with the U-shaped clip 50 affixed with the container 22 and with the second end 48 of the clip body inserted into the pocket 30, the container clip 10 and the container 20 are supported by the pocket 30. The token 15 may be interchanged with a different token 15 in the token holder 80 as desired, and can be included with the container clip 10 or not.

In some embodiments a pinch handle 110 (FIGS. 3 and 5) is included along the clip body 40 between the first end 42 and the second end 48. Such a pinch handle 110 provides a convenient place to grasp the container clip 10 when attaching the U-shaped clip 50 to the neck portion 21 of the container 20, or when removing the container clip 10 from the container 20. The pinch handle 110 adds rigidity to the clip body 40, providing the clip body 40 with the strength to maintain the container 20 suitably away from the garment 16 when in use.

While a particular form of the invention has been illustrated and described, it will be apparent that various modifications can be made without departing from the spirit and scope of the invention. For example, the shape of the projections 70 and the token holder 80 may be modified from those shown in the figures. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A container clip for securing a container to a pocket, comprising:

a clip body having a first end and an opposing second end;

the first end of the clip body terminating with a resilient U-shaped clip having two prongs configured for securing around a portion of the container in a common plane, each prong terminating at a distal end thereof at an inwardly-facing projection;

the second end of the clip body terminating at a token holder configured for holding a token having one of a plurality of different visual appearances;

the clip body curved downwardly away from the common plane of the U-shaped clip such that the container clip curves down around a top portion of the container;

whereby with the U-shaped clip affixed with the container and with the second end of the clip body is inserted into the pocket, the container clip and the container are supported by the pocket.

2. The container clip of claim 1 wherein the clip body, U-shaped clip, and token holder are all integrally formed from a resilient plastic material.

3. The container clip of claim 1 wherein the clip body, U-shaped clip, and token holder are all integrally formed from a resilient, injection-molded plastic material.

4. The container clip of claim 1 wherein the inwardly-facing projections are triangular.

5. The container clip of claim 1 wherein the inwardly-facing projections are circular.

6. The container clip of claim 1 wherein the token holder is circular and includes a recess for receiving the token therein.

7. The container clip of claim 6 wherein the token holder includes an embedded magnet configured for holding the token that is magnetically attractive.

8. The container clip of claim 1 wherein the token holder further includes a keyring loop at a distal end thereof.

9. The container clip of claim 6 wherein the token holder receives the token with a friction fit, whereby bending the token holder releases the token.

10. A set of the container clips of claim 3 wherein each container clip in the set is made with the resilient, injection-molded plastic of a unique color.

11. The container clip of claim 1 wherein the clip body includes a pinch handle formed therein between the first and second ends, whereby the pinch handle provides a handle for grasping when affixing the container clip to the container or when removing the container clip from the container.

12. A container clip for securing a container to a pocket, comprising:

a clip body having a first end and an opposing second end;

the first end of the clip body terminating with a resilient U-shaped clip having two prongs configured for securing around a portion of the container in a common plane, each prong terminating at a distal end thereof at a triangular, inwardly-facing projection;

the second end of the clip body terminating at a circular token holder having a recess configured for holding a token having one of a plurality of different visual appearances, the token holder including an embedded magnet configured for holding the token that is magnetically attractive, the token holder alternately receiving the token with a friction fit whereby bending the token holder releases the token;

the clip body curved downwardly away from the common plane of the U-shaped clip such that the container clip curves down around a top portion of the container;

wherein the clip body, U-shaped clip, and token holder are all integrally formed from a resilient, injection-molded plastic material; and wherein the clip body includes a pinch handle formed therein between the first and second ends, whereby the pinch handle provides a handle for grasping when affixing the container clip to the container or when removing the container clip from the container;

wherein the token holder further includes a keyring loop at a distal end thereof;

whereby with the U-shaped clip affixed with the container and with the second end of the clip body is inserted into the pocket, the container clip and the container are supported by the pocket.

* * * * *